US005572751A

United States Patent [19]

Brandt

[11] Patent Number: 5,572,751

[45] Date of Patent: Nov. 12, 1996

[54] BUNK BED TRUNDLING SYSTEM

[76] Inventor: James C. Brandt, 4325 E. Clinton Trail, Eaton Rapids, Mich. 48827

[21] Appl. No.: 426,046

[22] Filed: Apr. 21, 1995

[51] Int. Cl.[6] ..... A47C 19/20

[52] U.S. Cl. ..... 5/9.1; 5/2.1; 5/8; 5/281; 5/285

[58] Field of Search ..... 5/2.1, 8, 9.1, 201, 5/281, 282.1, 285

[56] References Cited

U.S. PATENT DOCUMENTS

| | | | |
|---|---|---|---|
| 2,853,716 | 9/1958 | Sevcik . | |
| 2,888,687 | 6/1959 | Lindsey . | |
| 3,336,605 | 8/1967 | Neunherz et al. | 5/281 X |
| 3,886,604 | 6/1975 | Ewing | 5/9.1 X |
| 4,109,328 | 8/1978 | Mason | 5/8 |
| 4,232,411 | 11/1980 | Speyer | 5/2.1 X |
| 5,146,631 | 9/1992 | Deal . | |
| 5,233,707 | 8/1993 | Perkins . | |

FOREIGN PATENT DOCUMENTS

| | | | |
|---|---|---|---|
| 1130064 | 1/1957 | France . | |
| 414953 | 9/1946 | Italy . | |
| 276223 | 8/1927 | United Kingdom . | |
| 756761 | 9/1956 | United Kingdom . | |
| 2020966 | 11/1979 | United Kingdom . | |
| 2231788 | 11/1990 | United Kingdom | 5/9.1 |

*Primary Examiner*—Michael F. Trettel
*Attorney, Agent, or Firm*—Waters & Morse, P.C.

[57] ABSTRACT

A bunk bed system in which separate beds are positionable as free standing beds, as regular bunk beds, or as a perpendicular bunk bed system comprises a headboard extender that attaches to a side of a lower bed and a footboard extender incorporated into a bookcase. The headboard and footboard extenders each comprise two extender posts that engage the upper bed support posts and support the upper bed perpendicularly over the lower bed. One extender post of the headboard extender is attached to a headboard support post of the lower bed by means of rectangular end caps that fit over the upper and lower ends of both legs and hold them together. Locking pins extend between the extender posts and the lower ends of the legs of the upper bed to hold the stacked legs in alignment. Another extender post of the headboard extension is attached to the lower bed frame by means of a hook that is tightened over the bed frame. Openings are formed in the side of the bookcase so the bookcase can serve as a ladder to climb onto the upper bed. The headboard extender can be stored on the back of the bookcase when not in use, with the end caps holding the headboard extender in place.

11 Claims, 3 Drawing Sheets

BUNK BED TRUNDLING SYSTEM

FIELD OF THE INVENTION

The present invention relates generally to modular bedroom furniture. More particularly, this invention relates to bunk beds which may be selectively positioned as freestanding beds or interchangeably stacked as conventional bunk beds or as a perpendicular bunk bed system.

BACKGROUND OF THE INVENTION

The condition of limited space in present housing has created the need for furniture which uses minimal floor space. To meet this need, modular furniture has been developed which can be assembled to create space-saving units in limited spaces while still affording the user the option of separating or rearranging the furniture in additional positions when the housing arrangements allow more spacious use. Modular furniture is particularly useful in bedrooms where the use of space-saving furniture provides sleeping space for more than one person in a single room.

A standard bunk bed system provides extra space by allowing conventional beds to be stacked one on top of the other, providing individual sleeping areas with the same room while still providing spacious floor area. The conventional bunk bed system is widely used; however, it is limited to positioning the beds only as vertically stacked in parallel. Some perpendicular bunk bed systems have been developed, but the stacking devices have been rather permanently attached and have not provided for easy disassembly and storage of the stacking mechanism.

It is desirable to provide room occupants with the option of stacking modular beds in other positions not possible with conventional bunk beds, in order to allow the occupants some versatility and choice in arranging a bedroom to fit their desires and needs. Supplying the desires and needs of multiple individuals to have more versatility is of particular importance in situations such as college or other dormitory housing where dwellings are created to house large numbers of students in minimal space. Dormitory housing provides living quarters for hundreds of students in a single building by combining the sleeping area and the living area of multiple students into one room. As a result, it becomes necessary to arrange the room in order to accommodate multiple beds and additional furniture. The fluctuation of new residents in the rooms each school year makes it desirable to have bed stacking furniture comprise only a few pieces that are easy and safe to assemble and store, thus limiting the number of pieces capable of being lost and furniture which is easy and convenient to store.

An object of the present invention is to provide a bunk bed system that allows the user to selectively position the beds as unstacked or stacked as a regular bunk bed or as a perpendicular bunk bed system and to provide a stacking device that is storable in the same room with little loss of space when the stacking device is not being used.

SUMMARY OF THE INVENTION

The present invention is a bunk bed system in which conventional beds are positionable as free standing beds or as a regular bunk bed or as a perpendicular bunk bed system. To position the beds as the perpendicular bunk bed system, the system uses a headboard extender attached to a side and support post of the corner bed and a footboard extender incorporated into a bookcase. The headboard and footboard extenders engage the upper bed support posts and support the upper bed perpendicularly over the lower bed.

The headboard extender mounts to the lower bed so that one leg or extender post of the headboard extender is mounted flush against one of the legs or support posts of the lower bed headboard. Rectangular end caps fit over the upper and lower ends of both legs and hold them together. The upper cap at least has an opening in the upper portion thereof, so that a locking pin can extend between the headboard extender leg and the lower end of one of the legs of the headboard of the upper bed. The same type of pin fastens the other leg of the upper headboard with the other leg of the headboard extender. The other leg of the headboard extender is attached to the bed frame of the lower bed by means of a hook that can be tightened over the bed frame by a wing nut threaded on the opposite end of the hook.

The opposite end of the upper bed is similarly pinned on footboard extender legs or posts that are mounted in the back corners of the bookcase. Openings are formed in the side of the bookcase so the bookcase can serve as a ladder to climb onto the upper bed. The openings preferably are positioned slightly below the middle shelf in the bookcase, so that a person does not step on the shelf and knock things over when the foot is inserted in through opening.

Another feature of the invention is the manner in which the leg extenders are stored in an out-of-the-way place in the same room when they are not being used. The headboard extender is removed from the lower bed by unhooking the hook and releasing the upper and lower caps that fit over the respective ends of the lower bed leg and the extender leg. The headboard extender is then mounted on the back of the bookcase as shown, with the end caps mounted over the tops of the headboard and footboard legs to hold them together. The hook can simply be hung on one of the cross bars. The bookcase is then placed flush against the wall, concealing and compactly storing the extender legs.

DETAILED DESCRIPTION OF PREFERRED EMBODIMENT

Figure 1:
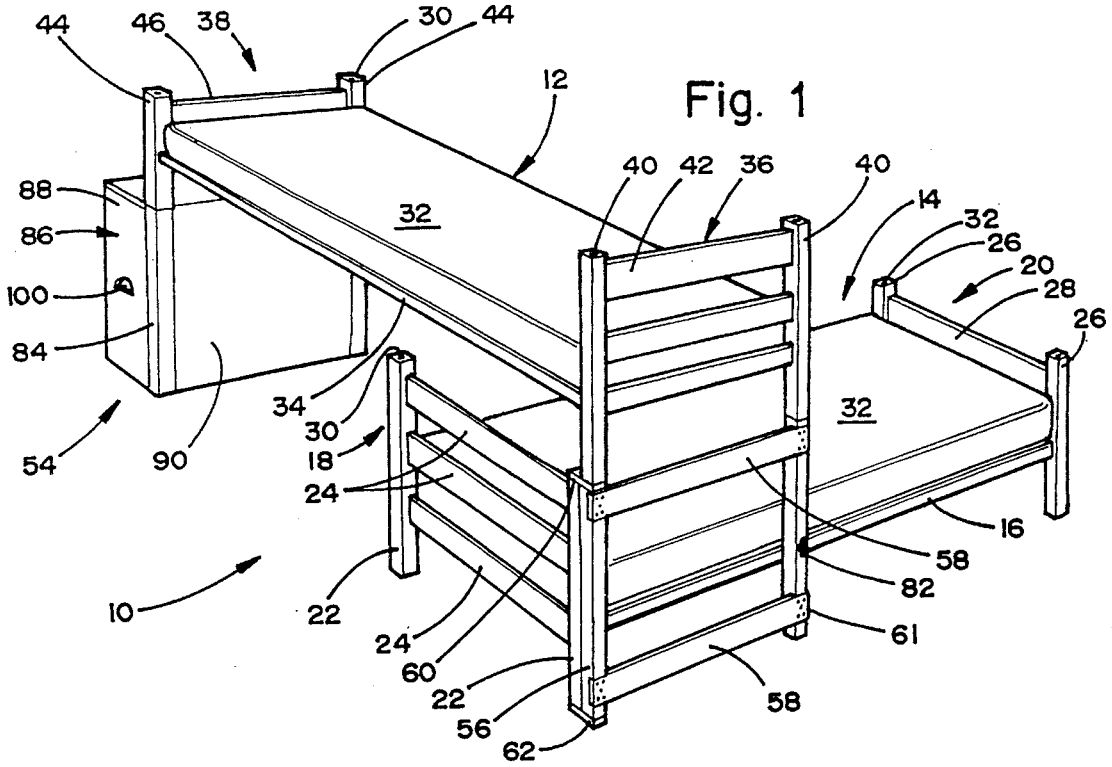
FIG. 1 is a perspective view of a bunk bed system as positioned in a perpendicular arrangement employing the trundling apparatus of the present invention.

Referring now to the drawings, a bunk bed assembly 10 is shown in FIG. 1 where an upper bed 12 is mounted over a lower bed 14 in a perpendicular or right angle position with respect to the lower bed. Beds 12 and 14 may be identical in size and shape, but they do not necessarily have to be.

Lower bed 14 comprises bed frame side rails 16 on each side of the bed, which are supported at their ends by support posts or legs of a headboard 18 and a footboard 20. Headboard 18 comprises support posts or legs 22 interconnected by cross members 24. Footboard 20 includes support posts or legs 26 rigidly interconnected by cross members 28. In the preferred practice of the present invention, the support posts are square or rectangular wooden beams and preferably are square beams two and one-half inches on a side. These beams have flat upper ends. The beds are provided with conventional mattresses 32.

Upper bed similarly includes side rails 34, a headboard 36 and a footboard 38. The headboard is shown at the right side in FIG. 1 but can be at either end of the bed.

Figure 5:
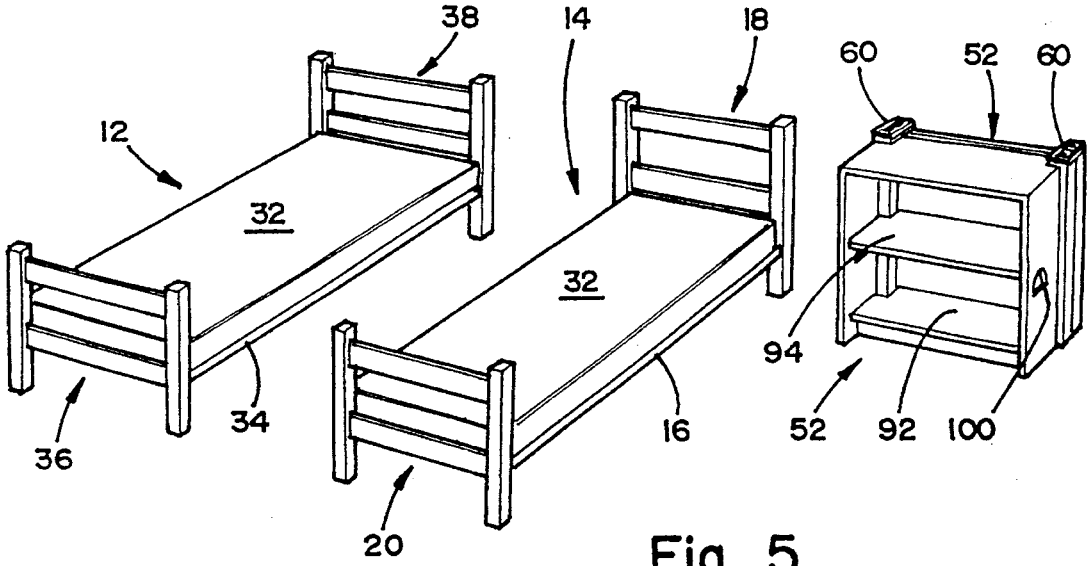
FIG. 5 is a perspective view of the beds positioned as conventional free standing beds illustrating the storage of the headboard extender behind the bookcase.

Headboard 36 of the upper bed includes support posts 40 interconnected by cross members 42. Footboard 38 of the upper bed includes support posts or legs 44 interconnected by cross members 46. As shown in FIG. 5, the upper and lower beds can be used as single beds and positioned side-by-side.

Alternatively, the beds can be mounted perpendicularly with one bed over the other. An important feature of the present invention is a trundling system that makes it possible to orient the upper bed over the lower bed in perpendicular relationship as shown in FIG. 1. The trundling system of the present invention comprises a headboard extender 52 and a footboard extender 54, shown individually in FIG. 2. Headboard extender comprises a pair of vertical extender posts or legs 56 and 57 interconnected rigidly by cross members 58 at the upper and lower ends of the extender posts. Cross members 58 are recessed in slotted openings in the extender posts and are held rigidly in place by a plurality of fasteners, such as screws 61, as shown in FIG. 1.

Figure 3:
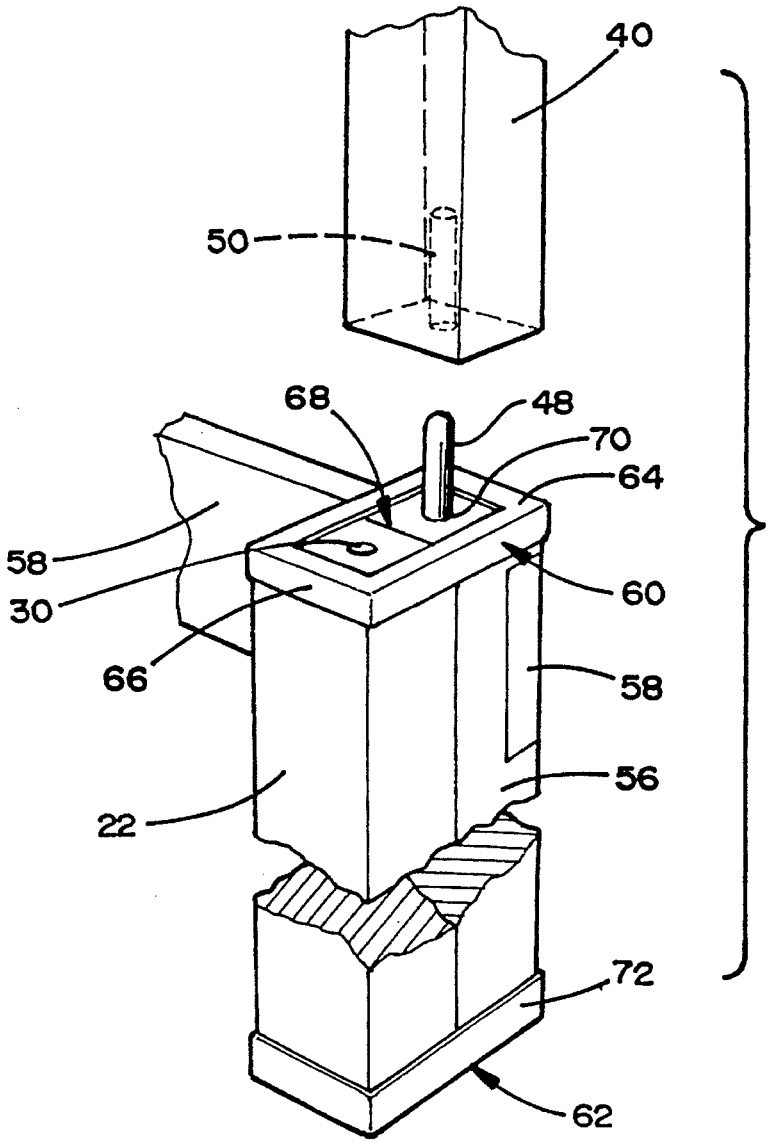
FIG. 3 is a fragmentary perspective view showing the manner in which a headboard extender leg is attached to the lower headboard leg by means of end caps.
Figure 4:
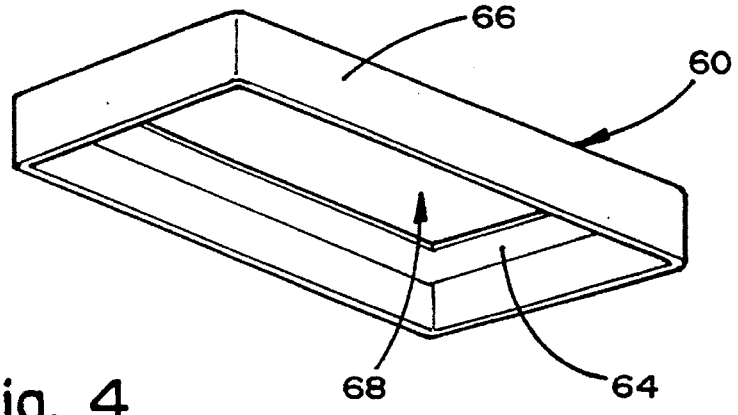
FIG. 4 is an enlarged perspective view of a rectangular end cap.

Headboard extender 52 is rigidly mounted to the side of lower bed 14 by means of a novel attachment mechanism. As shown in FIGS. 1 and 3, one of the extender posts 56 is mounted flush against the side of one of the support posts 22 of the lower bed headboard. Desirably, these two posts are of the same height and have the same square or rectangular cross sectional shape. The end caps 60 and 62 (which may be identical with the exception that the positions of the end caps are reversed) are rectangular metal retainers having a flat rectangular top 64 and peripheral side walls 66 extending at right angles to the top. Top 64 has an opening 68 therein so as to expose an opening 70 in the top of extender post 56. As shown in FIG. 3, metal pin 48 is received in opening 70 and extends upwardly from the opening through the top of end cap 60. End cap 60 preferably is coated with a plastisol or other durable coating. Lower end cap 62 can be of the same configuration, with a flat bottom that engages the floor and upstanding peripheral side walls 72. As shown in FIG. 3, the end caps fit snugly over the upper and lower ends of the lower bed headboard post 22 and the extender post 56 and retains these two posts in abutting relationship against each other. The lower bed thus rigidly holds the extender post 56 in a vertical position.

Figure 2:
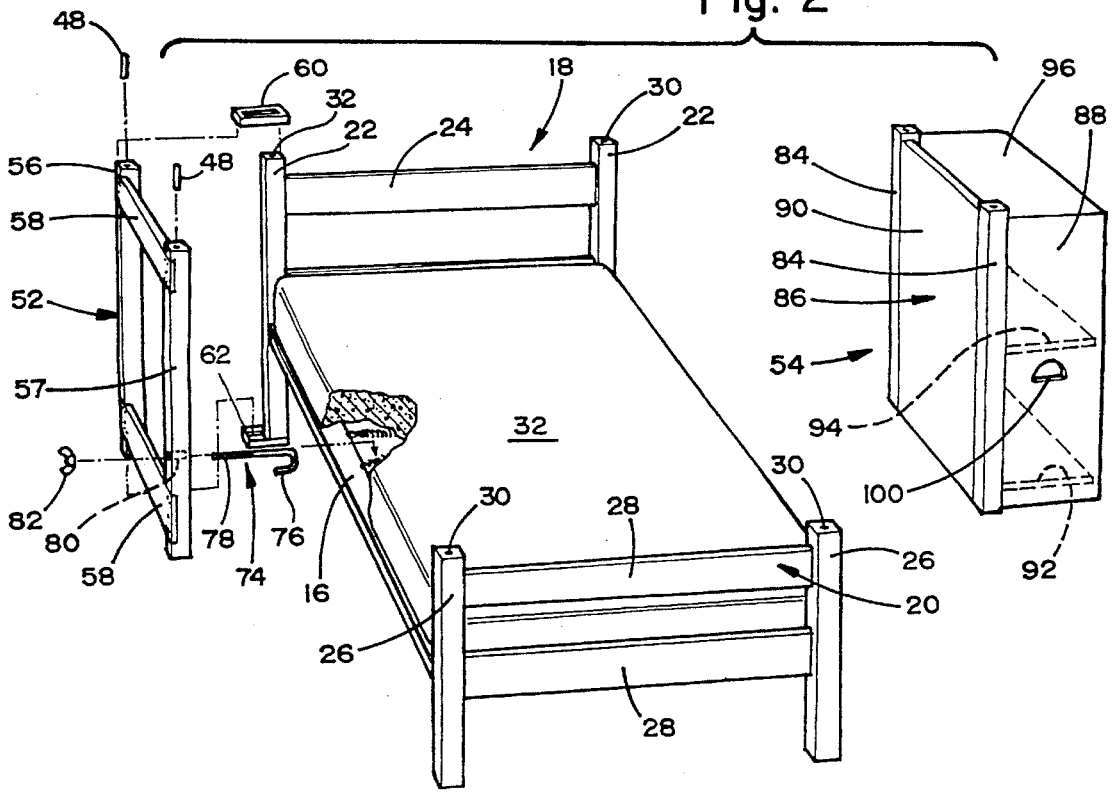
FIG. 2 is a perspective view showing the lower bed and extender elements of FIG. 1 in an exploded view and from a different perspective.

Extender post 57 is connected to the side of the bed frame at a point between the ends of the bed frame. To accomplish this, an elongated hook member 74 having a hook 76 at one end and a threaded stem 78 at the other end is employed. Threaded stem 78 extends through an opening 80 in extender post 57. Hook 76 fits over bed frame 16 (as shown in FIG. 2). A wing nut 82 is threaded on the threaded end 78 of the hook and is tightened in order to tighten the hook on the bed frame and bring leg 57 into a snug fit against the side of the bed frame.

With the headboard extender mounted in this way, the headboard extender is rigidly held in a vertical position and will not tip over.

Footboard extender 54 comprises a pair of extender posts 84 recessed in and securely fastened to rear corners of a bookcase 86. The bookcase includes side panels 88, a back panel 90, a base 92 extending between side panels and the back panel at the bottom of the bookcase, and a shelf 94 extending between the side panels and the back panel at an intermediate position in the interior of the shelf. A top panel 96 extends between the tops of side panels 88 and the top of back panel 90. Footboard extender posts 84 desirably are formed of wood beams having the same cross sectional configuration as the vertical beams employed in the headboard extension. The top ends of posts 84 have openings 98 therein that receive pins 48 in the same manner as the upper ends of the vertical extender posts of the headboard extender. The vertical extender posts of the headboard and footboard extenders are all of the same height and are spaced the same distance apart, which is the same distance as the lateral spacing between the corner support posts of the upper bed headboard and footboard. The bookcase in which the footboard extender posts are incorporated holds the footboard extender posts in a rigid upright position and prevents the footboard extender posts from tipping over.

The bookcase also provides an additional utilitarian function. Footholes 100 are formed in the side panels 88 of the bookcase so the sides of the bookcase serve as a ladder for climbing onto the upper bed. As shown in FIG. 2, the footholes are positioned slightly below bookshelf 94 so that a person's foot does not strike the objects on the shelf when a foot is inserted into the foothole.

As shown in FIG. 1, upper bed 12 is mounted on the lower bed after proper attachment and positioning of the headboard and footboard extenders by simply positioning the corner posts or legs of the upper bed on top of the headboard and footboard extender posts, with pins 48 positioned between the posts so as to hold the posts on top of each other and prevent the upper bed from being laterally dislodged off the extender posts.

While the headboard extender is shown attached to the right side of the lower bed in FIG. 1, with the upper bed extending over the lower bed from right to left, the orientation of the beds could be reversed, with the headboard extender being mounted on the left side of the lower bed and the upper bed extending from left to right across the lower bed and the bookcase being positioned on the right side of the lower bed.

Figure 6:
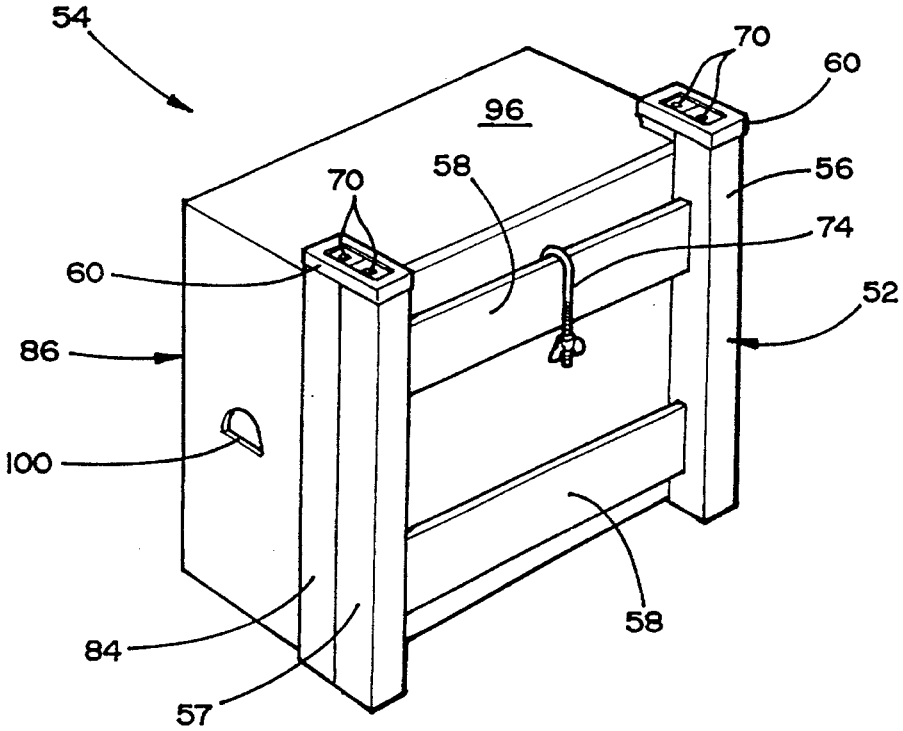
FIG. 6 is an enlarged rear view of the bookcase showing the headboard extender and hook as positioned for storage.

An important feature of the present invention is the ease with which the beds can be assembled or disassembled without requiring a significant number of extra components that can be lost of misplaced. When the beds are used as regular bunk beds or disassembled for use as single beds in the manner shown in FIG. 5, the entire trundling bed apparatus can be neatly stored in the same room without requiring any significant space in the room. As shown in FIG. 6, headboard extender 52 is simply mounted flush against the footboard extender posts 84 on the back side of the bookcase, and end caps 60 and 62 are placed over the upper ends of the posts in order to hold the headboard extender in position on the back of the bookcase. The hook 74 can be hung on cross members 58 where it will be out of sight. The bookcase can then be pushed against the wall. The entire space occupied by the stored extender posts will be the thickness of the headboard extender, which is about 2½ inches. Whenever the next occupants of the room desire to use the trundling apparatus, it is already in the room and readily accessible, and it is easy to assemble the beds in a stack securely and safely without any tools whatsoever.

The beds also can be used as regular bunk beds. If the headboards and footboards are the same height, the beds can simply be stacked together. Openings 30 in the top surfaces of the support posts accommodate alignment pins 48, which hold the stacked posts in alignment. This is a conventional way of maintaining alignment of conventional bunk beds. If, as shown in the present drawings, the headboards are higher than the footboards, it is necessary to switch the headboards and footboards around so that one bed has headboards at both ends and the other bed (usually the upper bed) has footboards at both ends. The beds can then be stacked on each other and remain level.

The foregoing represents an exemplary embodiment of the present invention. Various changes and modifications may be made in this embodiment without departing from the spirit and scope of the present invention, which is defined in the appended claims.

I claim:

1. Trundling apparatus for mounting an upper bed over a lower bed at right angles thereto, wherein the beds are supported on vertically oriented support posts at head and foot ends of the bed, the apparatus including:

a pair of support post extenders for raising the position of the upper bed, each support post extender comprising a pair of extender posts of predetermined height and means for connecting the extender posts rigidly together in parallel and spaced apart by the same distance as the support posts at the ends of the upper bed;

lower bed mounting means for releasibly connecting one extender to a side of the lower bed so that the plane of the extender is oriented parallel to the longitudinal direction of the lower bed, the mounting means securely holding one of the extender posts of the extender to an outer side of a support post of the lower bed, the extender being maintained in an upright position by the lower bed mounting means such that the extender posts can support the support posts at one end of the upper bed in a raised position, the extender being easily removable from the lower bed when perpendicular bed stacking is not desired;

vertical support means for maintaining the other extender in an upright position where the extender posts thereof can support the support posts at an opposite end of the upper bed in a raised position; and alignment means for holding the upper bed support posts in alignment on the extender posts.

2. Trundling apparatus as in claim 1 wherein the lower bed mounting means comprises extender post connection means for connecting one of the extender posts of one extender flush against the side of a lower bed support post, such that the lower bed support post holds the extender post in a fixed upright position.

3. Trundling apparatus as in claim 2 wherein the extender post connector means comprises at least one end cap that fits over upper ends of both the lower bed support post and the adjacent extender post when they are flush against each other in side-by-side position, the end cap encircling the ends of the posts and retaining them in abutting position.

4. Trundling apparatus as in claim 3 wherein end caps fit over top and bottom ends of the abutting lower bed support posts and the adjacent extender post.

5. Trundling apparatus as in claim 4 wherein the end cap fitting over the top ends of the posts has an opening in an upper side thereof, the alignment means comprising a pin that fits through said open top and fits in a pin receptacle in the extender post, the pin extending upwardly from the extender post and fitting in a pin receptacle in a bottom end of the adjoining upper bed support post.

6. Trundling apparatus as in claim 2 wherein the lower bed mounting means further comprises a hook attached to the other of the extender posts of said one extender, the hook extending outwardly from the other extender post and fitting over a side rail of the lower bed, the hook including tightening means for tightening the hook so as to bring the other extender post into snug engagement with the side rail.

7. Trundling apparatus as in claim 1 wherein the vertical support means comprises a bookcase to which the extender posts are mounted, the bookcase supporting the extender posts in the upright position.

8. Trundling apparatus as in claim 7 wherein the extender posts are incorporated into opposite rear corners of the bookcase.

9. Trundling apparatus as in claim 8 wherein the bookcase has vertical side panels at the sides of the bookcase, at least one side panel having a foot opening therein, such that the bookcase can serve as a ladder to facilitate access to the upper bed.

10. Trundling apparatus as in claim 7 and further including means for storing the extender that is attached to the side of the lower bed on the back of the bookcase when the trundling apparatus is not being used and said extender is detached from the lower bed.

11. A bunk bed system with trundle mounting means for mounting an upper bed on a lower bed in a perpendicular position with respect thereto, the upper and lower beds each comprising headboards and footboards at opposite ends of the bed, each headboard and footboard including a pair of support posts at opposite sides thereof, the support posts extending downwardly from a bed frame to serve as legs for the beds, the trundle mounting means including:

a headboard extender comprising a pair of extender posts rigidly interconnected in spaced parallel relationship, the spacing of the headboard extender posts being such that each headboard extender post can support one of the support legs at one end of the upper bed;

headboard extender mounting means for rigidly mounting the headboard extender to a side of the lower bed, with the plane of the headboard extender being perpendicular to the headboard of the lower bed;

a footboard extender comprising a pair of footboard extender posts mounted to a bookcase in a spaced upright position, the spacing of the footboard extender posts being such that each footboard extender post can support one of the support posts at an opposite end of the upper bed, the footboard extender being positionable in alignment with the headboard extender on an opposite side of the lower bed; and means for mounting the upper bed on the headboard and footboard extenders such that the extender posts support the upper bed support posts and are restrained from sideways dislodgment off the extender posts.

* * * * *